US011406177B1

(12) United States Patent
Solterbeck

(10) Patent No.: US 11,406,177 B1
(45) Date of Patent: Aug. 9, 2022

(54) TABLE WITH EXTENSIBLE AND RAISABLE SECONDARY WORK SURFACE

(71) Applicant: William D. Solterbeck, Hampton, VA (US)

(72) Inventor: William D. Solterbeck, Hampton, VA (US)

( * ) Notice: Subject to any disclaimer, the term of this patent is extended or adjusted under 35 U.S.C. 154(b) by 0 days.

(21) Appl. No.: 17/300,295

(22) Filed: May 17, 2021

(51) Int. Cl.
*A47B 1/05* (2006.01)
*A47B 1/10* (2006.01)

(52) U.S. Cl.
CPC ..... *A47B 1/05* (2013.01); *A47B 1/10* (2013.01)

(58) Field of Classification Search
CPC .... A47B 1/05; A47B 1/10; A47B 9/18; A47B 21/0314
See application file for complete search history.

(56) References Cited

U.S. PATENT DOCUMENTS 4,625,657 A * 12/1986 Little ..... A47B 21/0314 108/138
5,626,323 A * 5/1997 Lechman ..... A47B 21/0314 108/50.01
6,099,094 A * 8/2000 Lior ..... A47B 21/00 108/50.01
7,113,393 B2 * 9/2006 Kirchhoff ..... A47B 21/0314 361/679.2

* cited by examiner

*Primary Examiner* — Daniel J. Rohrhoff
(74) *Attorney, Agent, or Firm* — Jeffrey F. Riddle

(57) ABSTRACT

A table including a conventional table top, a stowable secondary work surface and optionally a stowable tertiary work surface is disclosed. The table may have height characteristics of a conventional coffee table. The secondary and tertiary surfaces are stowed under the primary surface, and extend outwardly therefrom into deployed positions on a telescoping linkage. A parallelogram mechanism enables the secondary surface to be higher than and parallel to the primary surface, thus enabling the primary surface to assume functions of the coffee table while the secondary surface is elevated thereabove to make work tasks more convenient for a seated user. The tertiary surface may be inclined relative to the primary and secondary surfaces. The secondary and tertiary surfaces and the linkage are concealed from view by a skirt depending from the primary surface. The novel table is thus convertible between a coffee table and a working desk.

11 Claims, 4 Drawing Sheets

TABLE WITH EXTENSIBLE AND RAISABLE SECONDARY WORK SURFACE

FIELD OF THE INVENTION

This invention relates in general to furniture, more particularly, to tables each having a horizontal table top, and still more particularly, to a table having a horizontal secondary work surface which both projects from the horizontal table top and automatically elevates above the horizontal table top, and optionally, an inclined tertiary work surface.

BACKGROUND OF THE INVENTION

Coffee tables typically are intended for casual or short term storage of food, beverages, and e.g. entertainment materials. Coffee tables are conventionally provided with short legs so that the table top is no higher than a seating surface of a sofa or chair occupied by a user of the coffee table. This situation is ideal for social uses of the coffee table, wherein people gather to talk and consume food and beverages, but is uncomfortable or awkward for home work uses. Coffee tables are frequently provided in residences to accommodate beverages and refreshments, particularly when entertaining guests. At other times, it may be desirable to utilize space occupied by a coffee table for office type tasks, such as work ordinarily performed in an office, which work is to be performed at home. Height of coffee tables is appropriate for social settings at a residence, but are typically too low to accommodate office type operations.

It would be desirable to have a coffee table convertible into a work support platform appropriate for office type operations.

SUMMARY OF THE INVENTION

This invention relates to tables, and more particularly, to a table providing a horizontal secondary work surface which can move between a stowed position concealed beneath the table top and a deployed position extending beyond horizontal bounds of the table top. When extending, the secondary work surface automatically elevates above the primary utilitarian surface. The table may also include an inclining tertiary work surface near the secondary work surface. The subject table may be of the type commonly known as a coffee table.

Home work uses may utilize personal computers of many different configurations, other electronic devices, other audio, video or data handling functions, writing materials, lamps and other illumination devices, and still other items which may be used for office type tasks. Conventional coffee tables are too low to support the peripheral items cited above at elevations suitable for frequent or ongoing use.

The present invention provides a table of the coffee table type which is convertible between a conventional coffee table and a table enabling work items to be supported at elevations above the table top suitable for protracted use. Moreover, the novel table supports the work items beyond bounds of the table so that the user's legs do not interfere with the table.

Various advantages of this invention will become apparent to those skilled in the art from the following detailed description of the preferred embodiment, when read in light of the accompanying drawings.

BRIEF DESCRIPTION OF THE DRAWINGS

Various features and attendant advantages of the novel table will become more fully appreciated when considered in view of the accompanying drawings, in which like reference characters designate the same or similar parts and/or features throughout the several views, and wherein.

Figure 1:
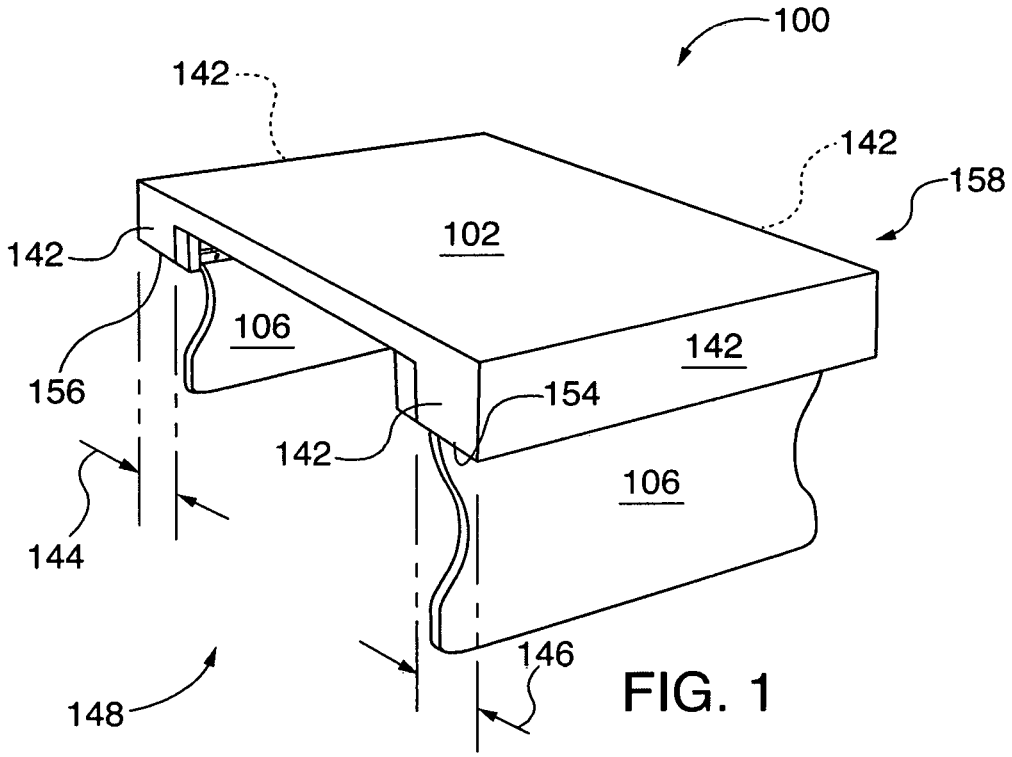
FIG. 1 is a rear perspective view of a table according to certain aspects of the disclosure.
Figure 2:
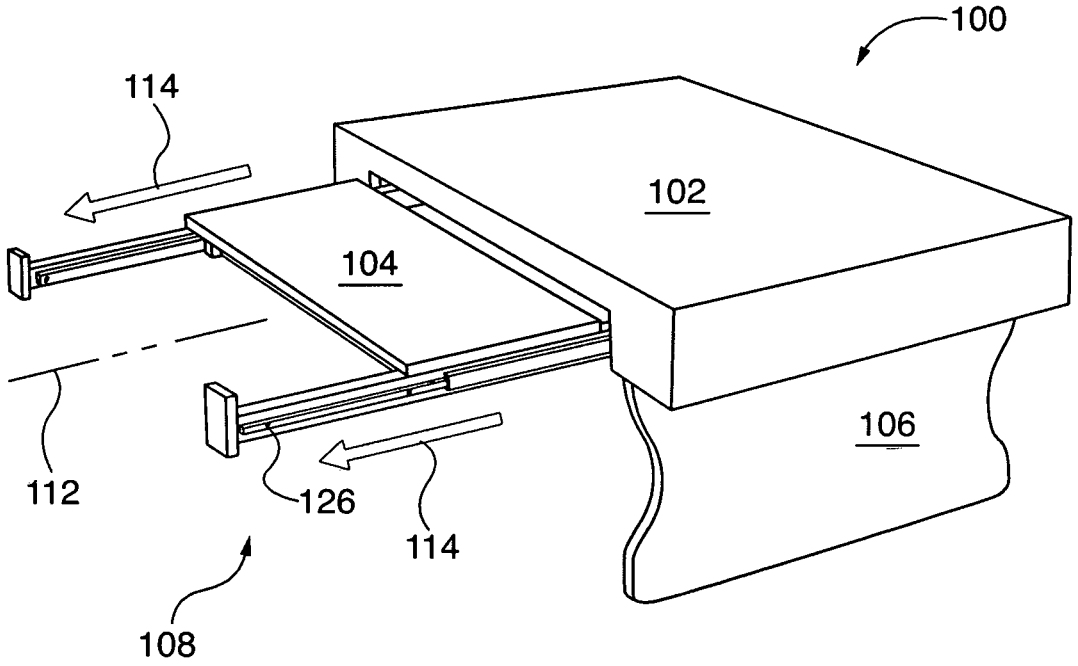
FIG. 2 is similar to FIG. 1, but shows a secondary work surface moved part way to a fully deployed position.
Figure 3:
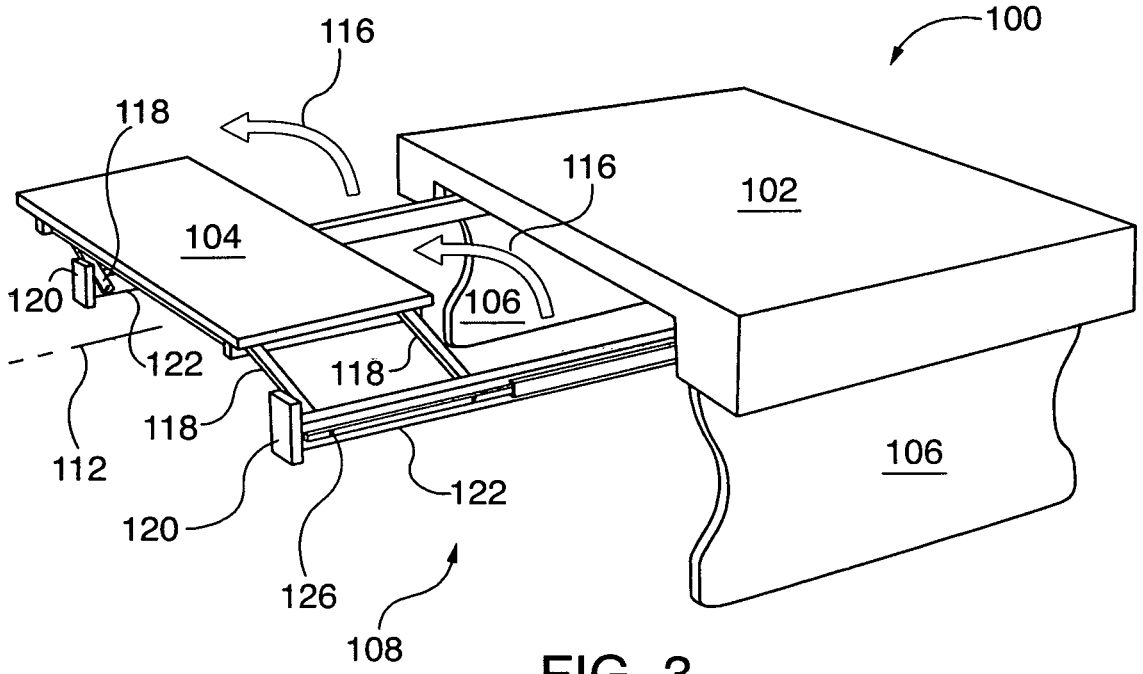
FIG. 3 is similar to FIG. 2, but shows a tertiary work surface moved into a fully deployed position.

The Drawing Figs. are drawn to internal and external scale. By internal scale it is meant that the parts, components, and proportions thereof in the illustrated inventive example are drawn to scale relative to one another. As employed herein, external scale refers to scale of the illustrated example relative to scale of environmental elements or objects shown in the drawings. Where external scale is asserted, the inventive and environmental elements are to scale relative to one another but of course may not be drawn to real or true life scale.

DETAILED DESCRIPTION OF THE PREFERRED EMBODIMENT

Referring now to the drawings, there is illustrated in FIGS. 1-7 a table 100 including a table top 102 and a deployable and stowable secondary work surface 104. Table 100 may comprise table top 102, at least one leg 106 supporting table top 102 above a horizontal environmental surface (such as a floor of a room, not shown), secondary work surface 104, the latter movable between a stowed position concealed beneath table top 102 and a deployed position located beyond bounds of table top 102 and elevated above table top 102, and a linkage 108 supporting secondary work surface 104 on table 100. Linkage 108 may be configured and dimensioned to enable secondary work surface 104 to move between the stowed position and the deployed position, and to maintain secondary work surface 104 parallel to table top 102 when moving between the stowed position and the deployed position.

It should be noted at this point that orientational terms such as right, left, above, and below are used for semantic purposes, e.g., to distinguish one element from a second, similar element. Therefore, orientational terms must be understood to provide semantic basis for purposes of description, do not necessarily apply to their literally construed meanings, and do not limit the invention or its component parts in any particular way.

The terms "table top" and "work surface" will be understood to include an associated three dimensional member, as context dictates, such as a board, a plate of plastic, ceramic, or metal, or any combination of these, and where context dictates, will not be limited to a theoretical plane or two dimensional surface.

Linkage 108 will be understood to include members connecting secondary work surface 104 and a tertiary work surface 110 to table 100, and members enabling secondary and tertiary work surfaces 104, 110 to move between their associated stowed and deployed positions. Linkage 108 will include at a minimum slide arms 122, pivot pins 126 (FIGS. 2-7), and pivot arms 118, for example. Not all elements of linkage 108 are shown. For example, right and left sides of linkage 118 may be concealed from view and may be of mirror image construction. Also, some necessary components such as bearings for telescoping slide arms may not be visible in the Drawing Figs. Such components are well known in the art, and need not be described in detail herein.

Figure 7:
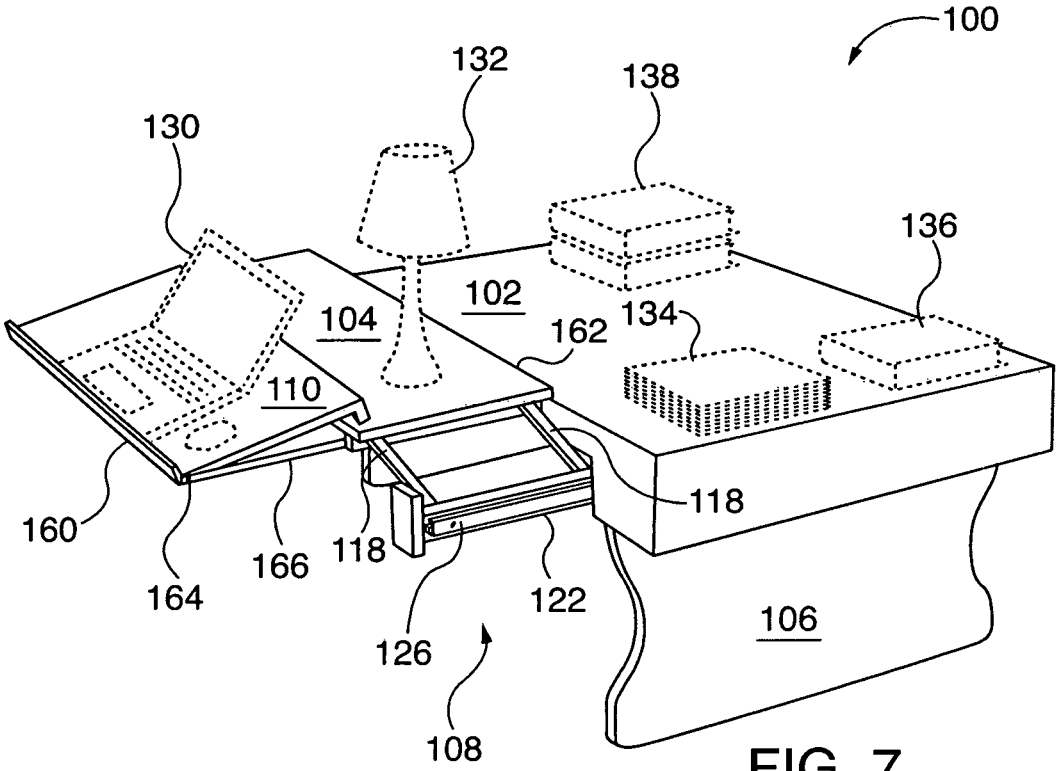
FIG. 7 is similar to FIG. 6, but shows the teriary work surface lowered fully into a slightly inclined deployed position.

A stowed position is that in which extensible members such as secondary work surface 104 are retracted out of sight beneath table top 102. A deployed position is that in which extensible members are intended to be used. FIG. 7 illustrates deployed positions of secondary and tertiary work surfaces 104 and 110.

Leg 106 may take on characteristics of a wall or panel, as illustrated in FIGS. 1-7, or may take on characteristics of a pole, or of any other configuration. Regardless of its configuration, leg 106 provides at least the function of supporting table top 102 horizontally above the supporting horizontal environmental surface.

Table 100 may further comprise tertiary work surface 110. Linkage 108 includes members supporting tertiary work surface 110 in an inclined position (FIGS. 6 and 7) relative to secondary work surface 104 when the latter is horizontal, and further from table top 102 than is secondary work surface 104. Table top 102, secondary work surface 104, and tertiary work surface 110 are arrayed along a common axis 112 parallel to a direction of deployment of secondary work surface 104. Arrows 114 (FIG. 2) indicate the direction of deployment of secondary work surface 104 as the latter is initially moved from the stowed position. Arrows 116 (FIG. 3) indicate further movement of secondary work surface 104 towards the deployed position. Secondary work surface 104 has reached maximum extension in FIG. 3, with further inclination prevented by interference of linkage arms 118 with stops 120 on slide arms 122. With secondary work surface 104 fully elevated by linkage arms 118, secondary works surface 104 may be moved against table top 102 to a final deployed position by retraction of slide arms 122.

Figure 4:
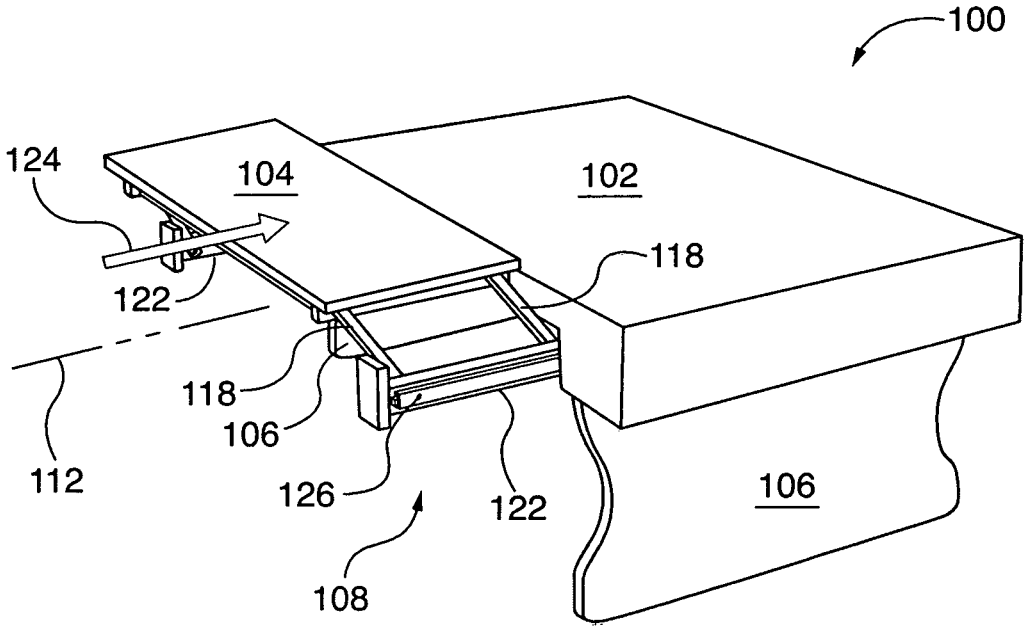
FIG. 4 is similar to FIG. 3, but shows the secondary work surface moved part way to a fully retracted position, concealed below a table top of the table.
Figure 5:
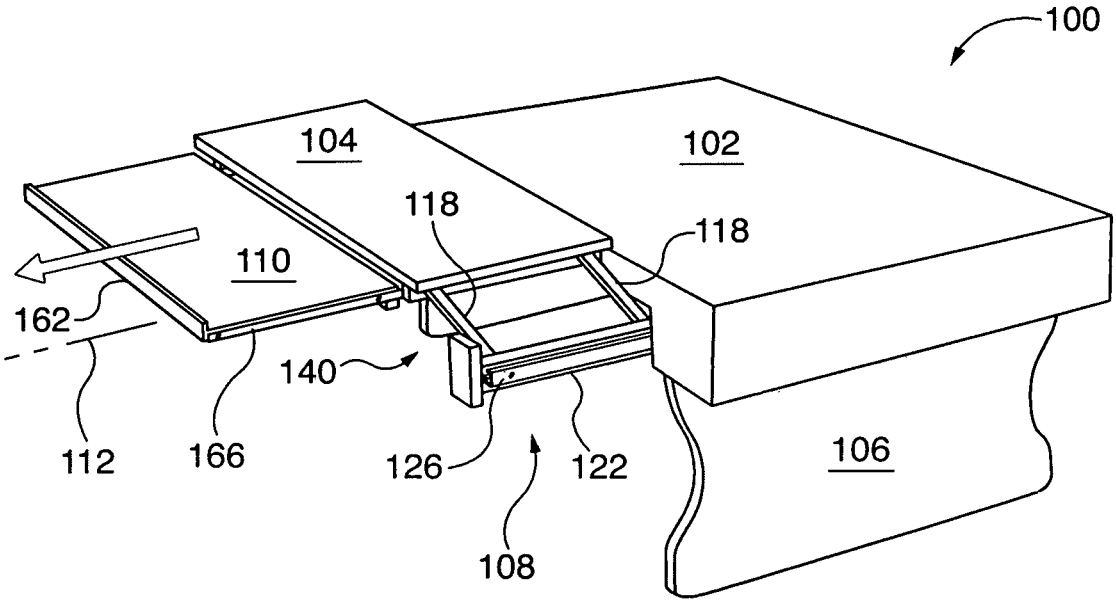
FIG. 5 is similar to FIG. 4, but shows the tertiary work surface moving into a deployed position, with the secondary work surface not fully extended into a full deployed position.
Figure 6:
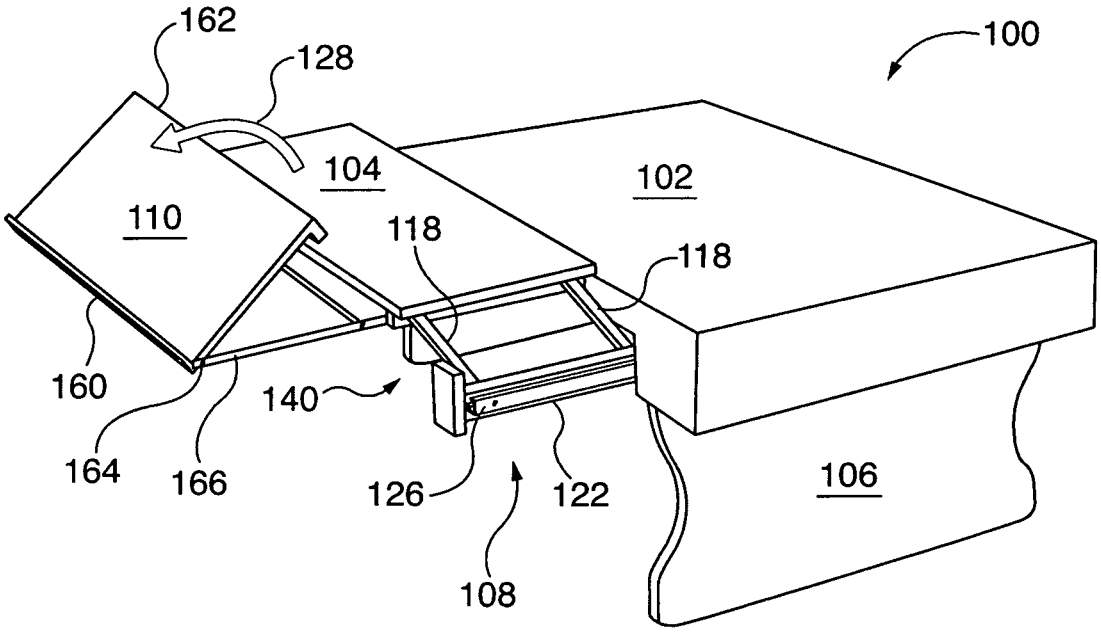
FIG. 6 is similar to FIG. 5, but shows the tertiary work surface in the course of being tilted into an inclined position.

It will be seen then that table 100 provides three functional work surfaces, including table top 102, secondary work surface 104, and tertiary work surface 110. The latter two work surfaces are independently moved to their respective deployed positions. This gives the user a choice of one, two, or three available work surfaces. Should the user desire to utilize only two work surfaces (e.g., table top 102 and secondary work surface 104, as seen in FIG. 4), then slide arms 122 may be telescopically collapsed, enabling secondary work surface 104 to be moved against table top 102, as indicated by arrow 124.

Should the user desire to utilize all three functional work surfaces, then with secondary work surface 104 extended, tertiary work surface 110 is extended from beneath secondary work surface 104 (shown in FIG. 5), tilted upwardly (as indicated by arrow 128, FIG. 6), and may be lowered into a final deployed position resting on secondary work surface 104, the latter shown in FIG. 7.

Use of all three functional work surfaces is illustrated in FIG. 7, with representative work materials such as a laptop computer 130, lamp 132, papers 134, a book 136, and a storage tray 138 shown in dashed lines.

Tertiary work surface 110 has a proximal pivotal edge 160 (FIGS. 6 and 7) and an opposed distal edge 162. Proximal pivotal edge 160 is pivotally coupled to linkage 108 such that distal edge 162 selectively faces table top 102 (FIGS. 6 and 7) and faces away from table top 102 (FIG. 5), depending on how far tertiary work surface 110 has been pivoted. Tertiary work surface 110 may pivot about a pivot pin 164 supported on a linkage arm 166 for example.

In the stowed position, secondary work surface 104 and its associated linkage 108 are below and within outer bounds of table top 102. As described herein, the outer bounds of table top 102 coincide with an outer perimeter of table top 102 when viewed from above.

Linkage 108 may comprise two parallel slidable arms 122 supported beneath table top 102. Each slidable arm 122 supports one side of secondary work surface 104. Preferably, each slidable arm 122 comprises telescoping arm segments. This is a known construction in furniture such as desks and need not be explained in detail.

Linkage 108 may comprise a collapsible parallelogram mechanism 140 (called out in FIGS. 5 and 6) maintaining secondary work surface 104 parallel to table top 102 when being moved between the stowed position and the deployed position. Parallelogram mechanism 140 may be directly coupled to two parallel slidable arms 122. Direct coupling signifies that elements of parallelogram mechanism 140 connect to slidable arms 122 without an intervening member. For example, pins 126 may not only enable pivot of linkage arms 118, but also couple linkage arms 118 to slide arms 122.

Figure 8:
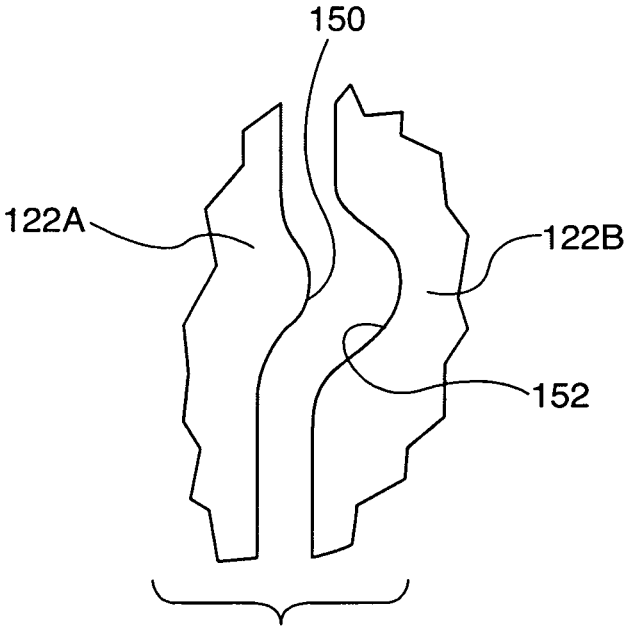
FIG. 8 is a side detail view of a feature of the table of FIGS. 1-7, and is drawn to enlarged scale.

Linkage 108 may comprise detents securing secondary work surface 104 at a predetermined distance from table top 102. The detents can be overridden by manual forces. An example is shown in FIG. 8, wherein one linkage member 122A includes a bump or projection 150, and an associated linkage member 122B includes a recess 152 which receives and frictionally retains projection 150. Interfit of projection 150 and recess 152 prevents secondary work surface from unintended movement along axis 112. Engagement of projection 150 and recess 152 is easily overcome by manual forces.

As called out in FIG. 1, table 100 may further comprise a skirt 142 depending from table top 102 outside a periphery of both secondary work surface 104 and linkage 108 such that secondary work surface 104 and linkage 108 are concealed from view of an observer (not shown) from a right side, a left side, and a front of table 100, when the observer views table 100 from thereabove and horizontally from any of the right side, the left side, and the front of table 100. In one specific arrangement, skirt 142 may depend from the periphery of table top 102. Note that it would be possible for skirt 142 to depend from table top 102 inside the perimeter of the latter. The function of skirt 142 is to conceal unornamented utilitarian components of secondary and tertiary work surfaces 104, 110 and linkage 108 from direct view from most directions of observation. Where it is desired to maximize area of secondary and/or tertiary work surfaces 104, 110, as shown in FIGS. 1-7, skirt 142 is coupled to the outermost portion of table top 102, i.e., at the perimeter of table top 102. However, where secondary and tertiary work surfaces 104, 110 are of lesser size, skirt 142 may correspondingly extend along less than the full extent of table top 102. In the latter case, skirt 142 may attach to table top 102 well within the perimeter of the latter, thus generating an overhang area of table top 102.

Again specifically referring to FIG. 1, skirt 142 may depend from table top 102 along right and left portions 144, 146 of a rear side 148 of table top 102 such that secondary work surface 104 and linkage 108 are visible from only a portion of rear side 148 of table top 102. In the example of FIG. 1, right and left portions 144, 146 account for a relatively small extent of rear side 148 of table top 102.

Table 100 may have a height such that table top 102 is within a range of twelve inches to twenty-four inches above a horizontal environmental surface, whereby table top 102 of table 100 has a height of a conventional coffee table above a floor surface.

As seen in FIGS. 1-7, legs 106 may include one right leg 106 terminating proximate a rear edge 154 of table top 102 and one left leg 106 terminating proximate a rear edge 156 of table top 102. This arrangement improves stability of table 100 by minimizing overhang of table top 102 over legs 106, particularly when legs 106 also terminate proximate front edges (not shown, but corresponding in location to rear edges 154, 156) at a front side 158 of table 100.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A table including a table top and a deployable and stowable secondary work surface, the table comprising:

the table top;

at least one leg supporting the table top above a horizontal environmental surface;

the secondary work surface, movable between a stowed position concealed beneath the table top and a deployed position located beyond bounds of the table top and elevated above the table top;

a linkage supporting the secondary work surface on the table, the linkage configured and dimensioned to enable the secondary work surface to move between the stowed position and the deployed position, and to maintain the secondary work surface parallel to the table top when moving between the stowed position and the deployed position; and a tertiary work surface, and the linkage includes members supporting the tertiary work surface in an inclined position relative to the secondary work surface when the latter is horizontal, and further from the table top than is the secondary work surface, wherein the table top, the secondary work surface, and the tertiary work surface are arrayed along a common axis parallel to a direction of deployment of the secondary work surface; wherein the tertiary work surface has a proximal pivotal edge and an opposed distal edge, and the proximal pivotal edge is pivotally coupled to the linkage such that the distal edge selectively faces the table top and faces away from the table top.

2. The table of claim 1, wherein the linkage comprises two parallel slidable arms supported beneath the table top.

3. The table of claim 2, wherein the linkage comprises a collapsible parallelogram mechanism maintaining the secondary work surface parallel to the table top when being moved between the stowed position and the deployed position.

4. The table of claim 3, wherein the collapsible parallelogram mechanism is directly coupled to the two parallel slidable arms.

5. The table of claim 2, wherein each one of the two parallel slidable arms comprises telescoping arm segments.

6. The table of claim 1, further comprising a skirt depending from the table top outside a periphery of both the secondary work surface and the linkage when the secondary work surface is in the stowed position such that the secondary work surface and the linkage are concealed from view of an observer from a right side, a left side, and a front of the table, when the observer views the table from above and horizontally from any of the right side, the left side, and the front of the table.

7. The table of claim 6, wherein the skirt depends from a periphery of the table top.

8. The table of claim 7, wherein the skirt also depends from the table top along right and left portions of a rear side of the table top such that the secondary work surface and the linkage are visible from only a portion of the rear side of the table top.

9. The table of claim 1, wherein the linkage comprises detents securing the secondary work surface at a predetermined distance from the table top, and the detents can be overridden by direct manual forces.

10. The table of claim 1, wherein the legs include one right leg terminating proximate a rear edge of the table top and one left leg terminating proximate a rear edge of the table top.

11. The table of claim 1, wherein table has a height such that the table top is within a range of twelve inches to twenty-four inches above the horizontal environmental surface, whereby the table top of the table has a height of a conventional coffee table above a floor surface.

* * * * *